United States Patent [19]

Drummond et al.

[11] Patent Number: 5,058,481

[45] Date of Patent: Oct. 22, 1991

[54] DUAL MODULAR ROCKET LAUNCHER

[75] Inventors: Lanny D. Drummond; Joseph E. Williams, II, both of Camarillo, Calif.

[73] Assignee: The United States of America as represented by the Secretary of the Navy, Washington, D.C.

[21] Appl. No.: 597,134

[22] Filed: Oct. 15, 1990

[51] Int. Cl.[5] ..... F41F 3/042

[52] U.S. Cl. ..... 89/1.816; 89/1.814

[58] Field of Search ..... 89/1.816, 1.817, 1.818, 89/1.814

[56] References Cited

U.S. PATENT DOCUMENTS

| | | | |
|---|---|---|---|
| 3,185,035 | 5/1965 | Gregory-Humphries | 89/1.816 |
| 3,342,104 | 9/1967 | Robert | 89/1.817 |
| 3,754,497 | 8/1973 | Rusbach | 89/1.814 |
| 3,841,197 | 10/1974 | Morrisey | 89/1.816 |
| 4,063,485 | 12/1977 | Carter et al. | 89/1.816 |
| 4,186,647 | 2/1980 | Piesik | 89/1.816 |
| 4,197,569 | 4/1980 | Millard et al. | 89/1.814 |
| 4,296,669 | 10/1981 | Debona et al. | 89/1.816 |
| 4,306,486 | 12/1981 | Oswell | 89/1.816 |
| 4,429,611 | 2/1984 | Oldham et al. | 89/1.816 |
| 4,470,336 | 9/1984 | Swann et al. | 89/1.816 |
| 4,556,438 | 12/1985 | Hoffmeister et al. | 156/245 |
| 4,604,939 | 8/1986 | Hoffmeister et al. | 89/1.816 |
| 4,635,527 | 1/1987 | Carrier et al. | 89/1.816 |

*Primary Examiner*—David H. Brown

*Attorney, Agent, or Firm*—David S. Kalmbaugh

[57] ABSTRACT

The rocket launcher in accordance with this invention includes a pair of modules fabricated from a lightweight composite material with each module having twelve lightweight composite tubes integrally formed therein. The tubes are located relative to each other within the modules so that the axis of each are generally parallel. Each module is aerodynamically configured such that the modules may be fastened together to form a rocket launcher which when attached to an aircraft is capable of launching twenty-four rockets. The rocket launcher of this invention may also be used to launch only twelve rockets by attaching only one module to the aircraft.

8 Claims, 4 Drawing Sheets

DUAL MODULAR ROCKET LAUNCHER

BACKGROUND OF THE INVENTION

1. Field of the Invention

This invention relates generally to rocket launchers and in particular to a novel rocket launcher structure having lightweight dual modules or casings for use with military aircraft.

2. Description of the Prior Art

Military aircraft typically provide close support for infantry and other troops. Such military aircraft are normally equipped with launchers for firing air to ground and air to air unguided rockets and other weapons.

In the past, the launchers used by the military which were compatible with aircraft had a launch tube structure capable of launching either seven or nineteen rockets from individual launch tubes to a target. These launchers were generally fabricated from aluminum and stainless steel making them incompatible with state-of-the-art technology tactical aircraft because of excessive weight, high visibility to radar, and high aerodynamic drag.

Thus, it can be seen that there is a need for a light weight tube launching structure that has a multiplicity of tubes of a lightweight material that can withstand stress and be clustered together with each tube being aligned relative to each of the other tubes thereby allowing rockets launched from the tubes to be directed accurately to a target.

With the above needs in mind, it is an object of the present invention to provide a structure for launching rockets that is compact, lightweight, economical and compatible with state-of-the-art tactical aircraft.

Still another object of the present invention is to provide a lightweight launch tube structure which has a multiplicity of tubes included therein, but the structure being such that the number of tubes can be varied when the structure is attached to an aircraft.

Yet another object of the present invention is to provide a lightweight launch tube structure which will require no special maintenance since the materials are generally nonmetallic and therefore corrosion resistant.

It is still another object of the present invention to provide a rocket launcher that is compatible with tactical military aircraft as well as helicopters.

Other objects and advantages of the present invention will best be understood by those skilled in the art from the following description when read in conjunction with the accompanying drawings.

SUMMARY OF THE INVENTION

The aforesaid and other objects of the invention are accomplished by a lightweight rocket launcher adapted for use with tactical and other military aircraft. The rocket launcher of the present invention includes a pair of modules or casings fabricated from a lightweight composite material with each module having twelve lightweight tubes integrally formed therein and fabricated from the same or similar composite material. The tubes are located relative to each other within the module so that the axis of each of the tubes are generally parallel. Each module is aerodynamically configured such that the modules may be fastened together to form a rocket launcher which when attached to an aircraft is capable of launching twenty-four rockets. The rocket launcher of the present invention may also be used to launch only twelve rockets by attaching only one module to the aircraft.

DETAILED DESCRIPTION OF THE PREFERRED EMBODIMENT

Figure 1:
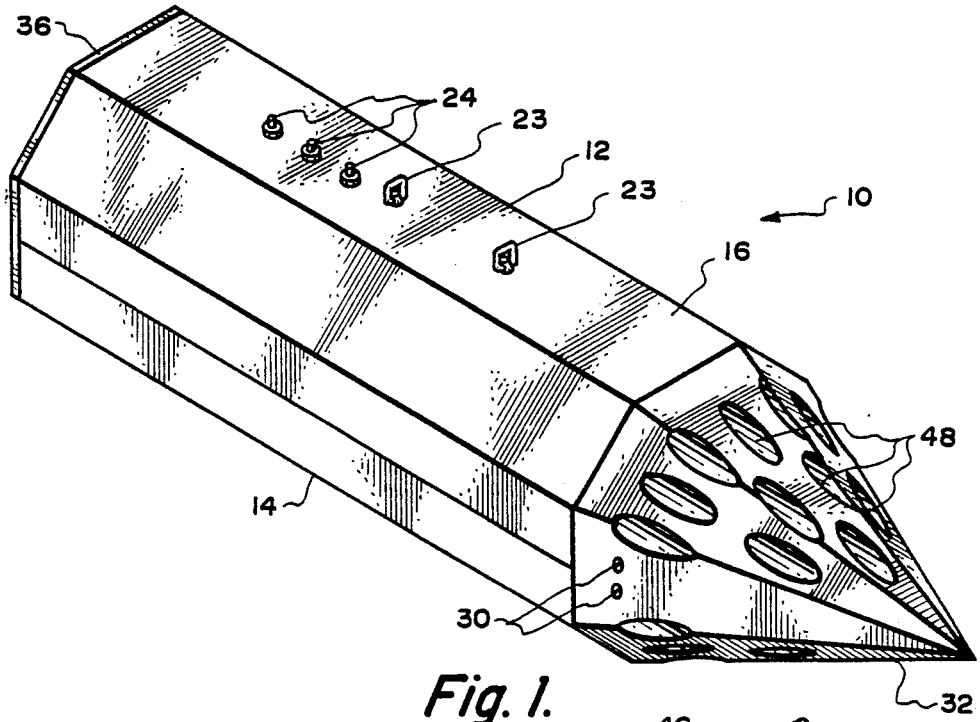
FIG. 1 is a perspective view of the rocket launcher constituting the present invention.
Figures 2, 3:
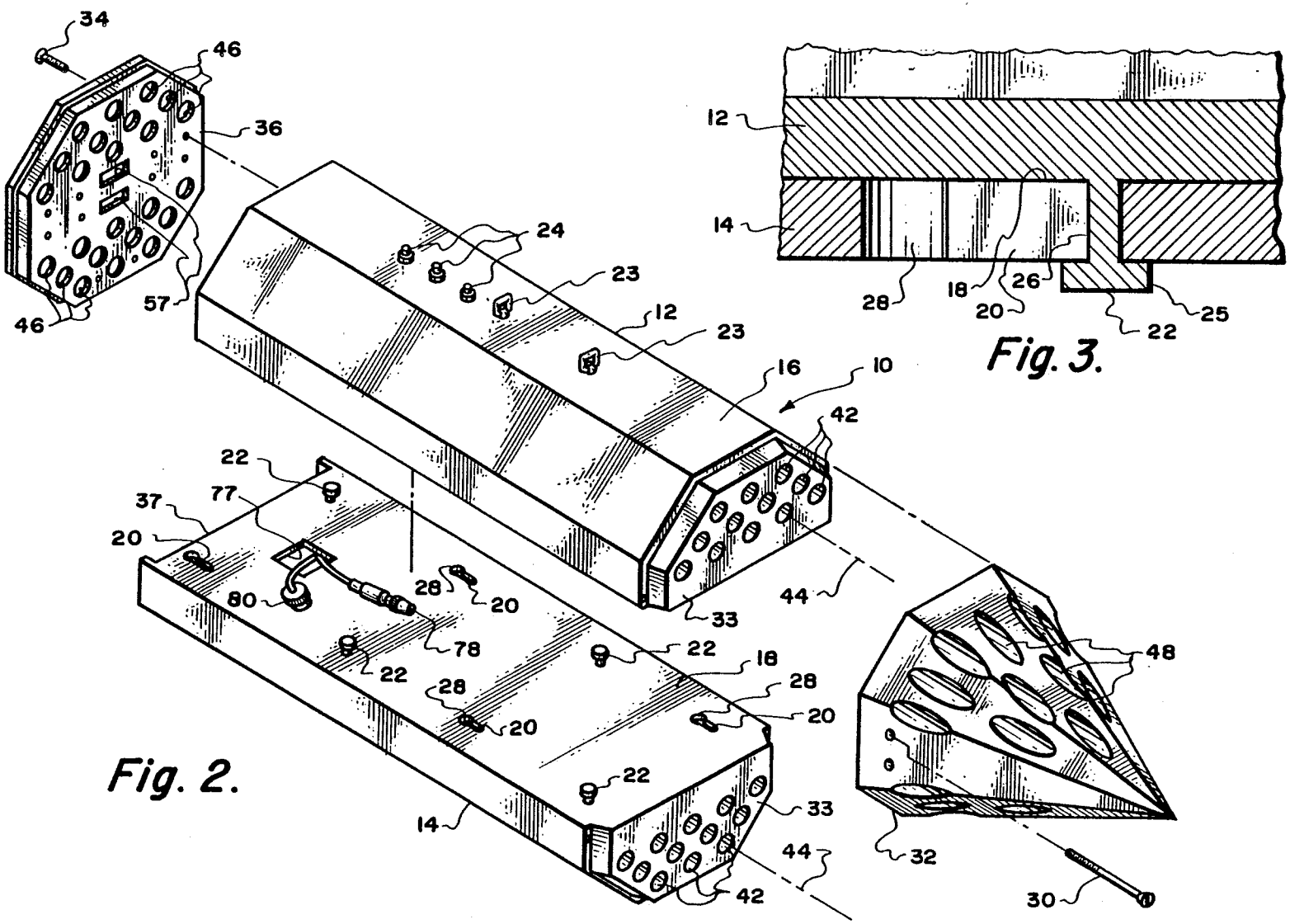
FIG. 2 is a disassembled view of the rocket launcher constituting the present invention.
FIG. 3 is a sectional view illustrating the engaging member and slot arrangement by which the dual modules are fastened together thereby a rocket launcher capable of launching twenty-four rockets.

Referring first to FIGS. 1 and 2 of the drawings a rocket launcher in accordance with the present invention is designated by the reference numeral 10 and as shown has a pair of elongated modules or casings 12 and 14 with each casing being identical in shape such that either casing 12 or casing 14 may be attached to an aircraft, not shown. Each elongated module 12 or 14 has an upper surface 16 and a lower or mating surface 18 with surface 18 having four slots 20 therein and four engaging members 22 extending therefrom. It should be noted that each slot 20 is positioned within mating surface 18 of casing 12 to align with one of the engaging members 22 of casing 14, while each slot 20 is positioned within mating surface 18 of casing 14 to align with one of the engaging members 22 of casing 12.

A pair of U shaped coupling members 23 are mounted on the upper surface 16 of each module 12 and 14 to provide for the connection of rocket launcher to the aircraft. There is also mounted in the upper surface 16 of each module 12 and 14 three electrical connecting receptacles 24 to allow for the connection of the rocket launcher's electronic circuit, illustrated in FIG. 6, to the aircraft electrical system.

Referring now to FIGS. 2 and 3 each engaging member 22 has a major diameter portion 25 and a minor diameter portion 26 and is integrally formed with mating surface 18. One end of each slot 20 has a circular shaped end 28, the diameter of which is greater than the diameter of portion 25 of engaging member 22 thereby allowing end 28 of slot 20 to receive the major diameter portion 25 of its aligned engaging member 22. The width of slot 20 is, in turn, greater than the diameter of portion 26 but less than the diameter of portion 25 thereby allowing engaging member 22 to slide to the position illustrated in FIG. 3 so as to prevent casing 12 from pulling away from casing 14 in the vertical direction.

Referring again to FIGS. 1, 2 and 4 a plurality of bolts 30 are used to secure a front fairing 32 to the front end 33 of casings 12 and 14, while a plurality of bolts 34 are used to secure a retention bulkhead 36 to the rear end 37 of casings 12 and 14. Fairing 32 and retention bulkhead 36, in turn, prevent casing 12 from pulling away from casing 14 in the horizontal direction. Fairing 32 also reduces aerodynamic drag at supersonic velocities by providing a smooth airflow path. Additional structural support for launcher 10 is provided by a pair of elongated plates 38 which are secured to each side of launcher 10 by bolts 41 as is best illustrated in FIG. 5.

Referring to FIG. 2, each module 12 and 14 which includes twelve launch tubes 42 may be fabricated from a lightweight composite material. The launch tubes 42 each have a center axis 44 along the horizontal length of launcher 10 with each axis 44 being substantially parallel to each of the other axis 44. Also, each axis 44 is substantially parallel to the longitudinal length of the upper surface 16 and the lower or mating surface 18 of each casing 12 and 14. In the preferred embodiment of the present invention each launch tube is approximately 6 feet in length, approximately 2.75 inches in diameter for compatibility with 2.75 inch airborne rockets and is integrally formed with the casing such that each casing 12 and 14 and the twelve tubes included therein form a unitary structure. Retention bulkhead 36 has twenty-four openings 46 therein with each opening 46 aligning with one of the launch tubes 42 of each module 12 or 14. Similarly, fairing 32 has twenty-four openings 48 therein with each opening aligning with one of the launch tubes 42 of each module 12 or 14. It should be noted that each opening 46 in bulkhead 36 and each opening 48 in fairing 32 has a diameter the same as the diameter of the launch tube with which it is aligned.

Any suitable material and/or manufacturing method may be used to fabricate each module 12 or 14 and the twelve launch tubes integrally formed therewith. For example, modules 12 and 14 may be integrally molded from a fiber reinforced synthetic resin, in accordance with state-of-the-art technology. A 30% glass fiber reinforced nylon may be used to fabricate modules 12 and 14. One such material is sold under the trademark Nylafil. It is strong, tough and shows very good resistance to corrosion. With such a material, no additional anti-corrosion coating or other finishing operation is required. Other suitable materials which may be used to fabricate modules 12 and 14 are fiberglass materials such as an E-glass filament, Kevlar, and graphite composite. In addition, it should be noted that carbon fiber/thermoplastic materials which have a demonstrated burn through protection and are adaptable to state-of-the-art injection molding technology may be used to fabricate modules 12 and 14.

Figure 4:
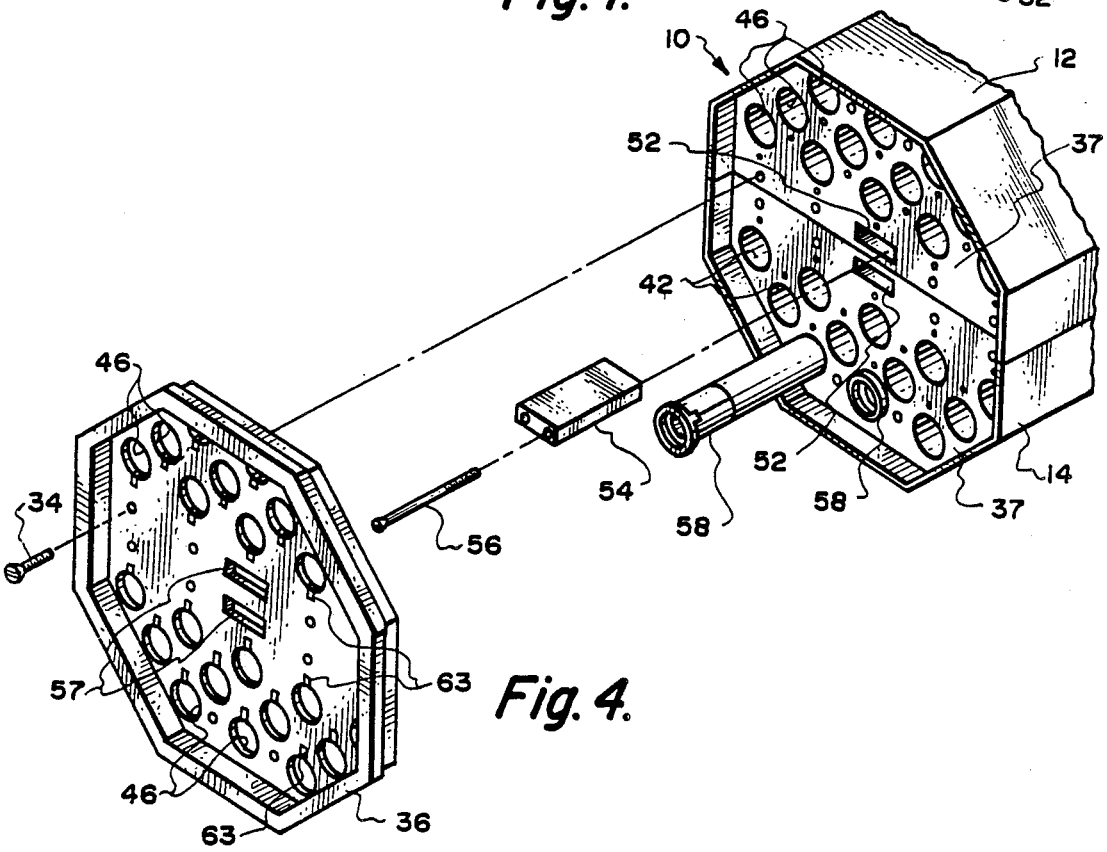
FIG. 4 is an end view illustrating the bulkhead disassembled from the two modules of the present invention.
Figure 5:
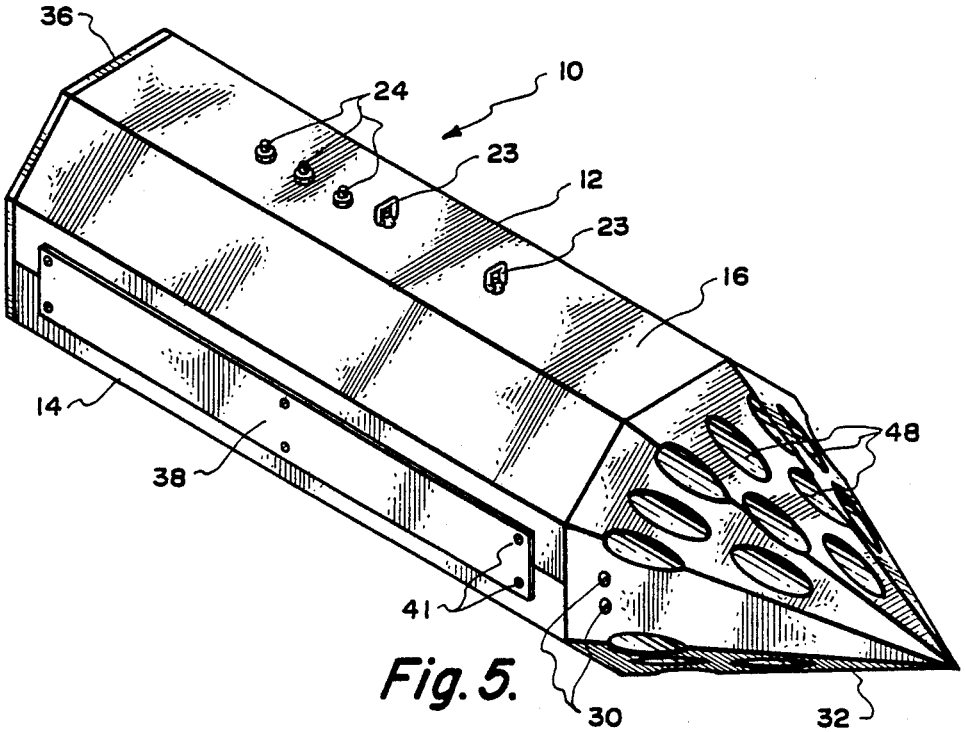
FIG. 5 illustrates the use of side plates to provide added structural support for the rocket launcher constituting the present invention.
Figure 6:
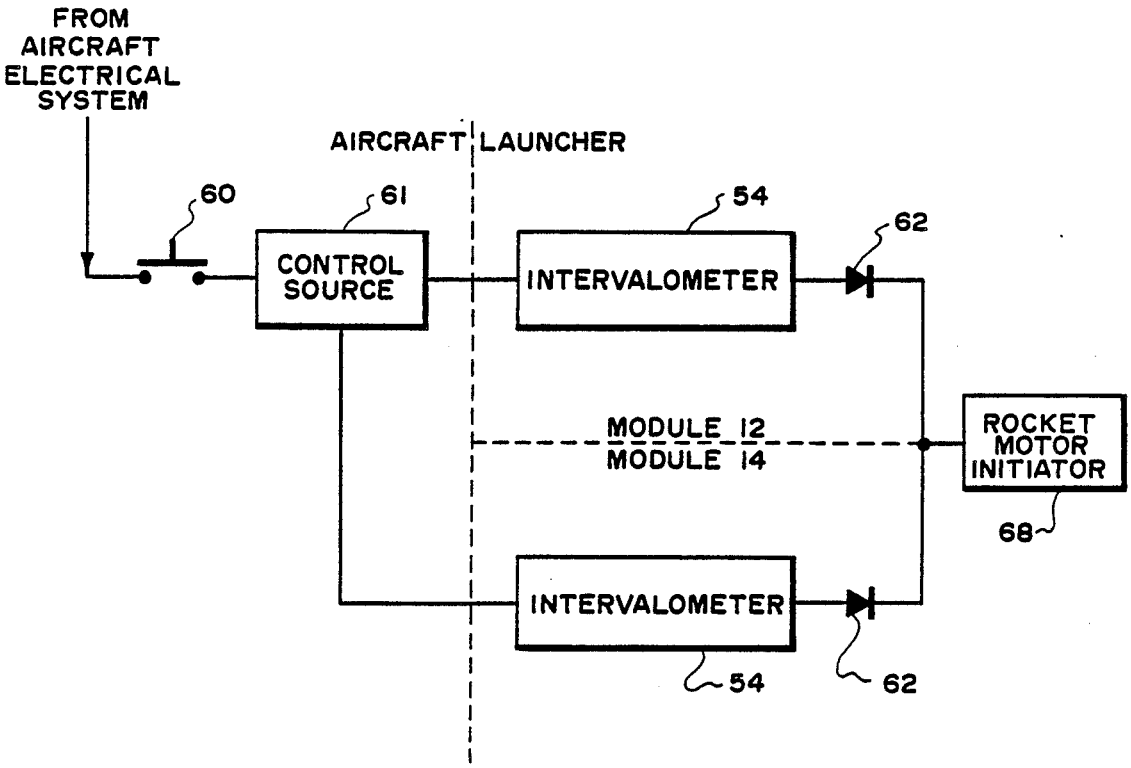
FIG. 6 is a schematic diagram of the intervalometer initiated electronic circuit used to fire a rocket from the present invention.
Figure 7:
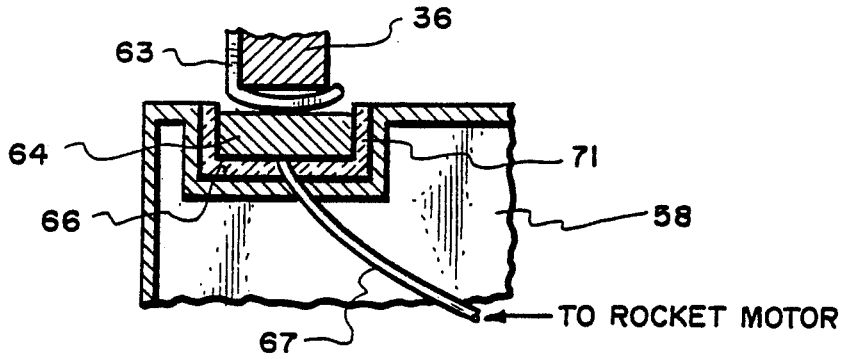
FIG. 7 is an enlarged view in section illustrating the point of contact between the firing ring of a rocket and one of the contact fingers of the retention bulkhead.

Referring to FIGS. 4, 6 and 7 each rear end 37 of module 12 or 14 has a rectangular shaped slot 52 adapted to receive an intervalometer 54 which is secured to slot 52 by a pair of bolts 56. Retention bulkhead 36 also has a pair of rectangular shaped openings 57, with each opening 57 aligning with one of the rectangular shaped slots 52.

Typically, the firing of a rocket 58 from rocket launcher 10 is initiated by the pilot by closing a fire control button 60 allowing a coded control signal from a source 61 to activate either the intervalometer 54 within module 12 or the intervalometer 54 within module 14. The intervalometer 54 successively delivers pulses of current in a predetermined sequence and at predetermined intervals to each of the twenty-four rockets 58 to be fired from rocket launcher 10. A pulse of current from intervalometer 54 to fire one of the twenty-four rockets 58 from rocket launcher 10 passes through a diode 62, which is forward biased to a contact finger 63 position on the periphery of each opening 46 of bulkhead 36. The contact finger 63, in turn, makes contact with a firing ring 64 recessed within a channel 66 located in the rear of rocket 58. The firing ring 64 is connected by a wire 67 to a rocket motor initiator 68, which allows the pulse of current provided by intervalometer 54 to initiate the firing of a rocket motor, not shown, launching rocket 58 from rocket launcher 10. It should be understood that each module of rocket launcher 10 is adapted to receive an intervalometer and that the intervalometer within either module 12 or module 14 can fire each of the twenty-four rockets from rocket launcher 10. Diode 62, in turn, protects the intervalometer within either module 12 or 14 not being utilized to fire rockets from launcher 10 since this diode is now reversed biased. It should also be noted that there is an electrical insulation material 71 within channel 66 upon which firing ring 64 is positioned within channel 66.

Since intervalometers are well known in the art, a detailed description of the operation of an intervalometer will not be provided at this time. For details relating to the structure and operation of an intervalometer reference is made to U.S. Pat. No. 4,197,569 entitled "Intervalometer" issued to Keith W. Millard and Marlin E. Crain. At this time it should be noted that a data bus remote terminal which meets the requirements of military standard MIL-STD-1553b may also be used in the preferred embodiment of the present invention to trigger the sequential firing of rockets 58 from launcher 10.

Figure 8:
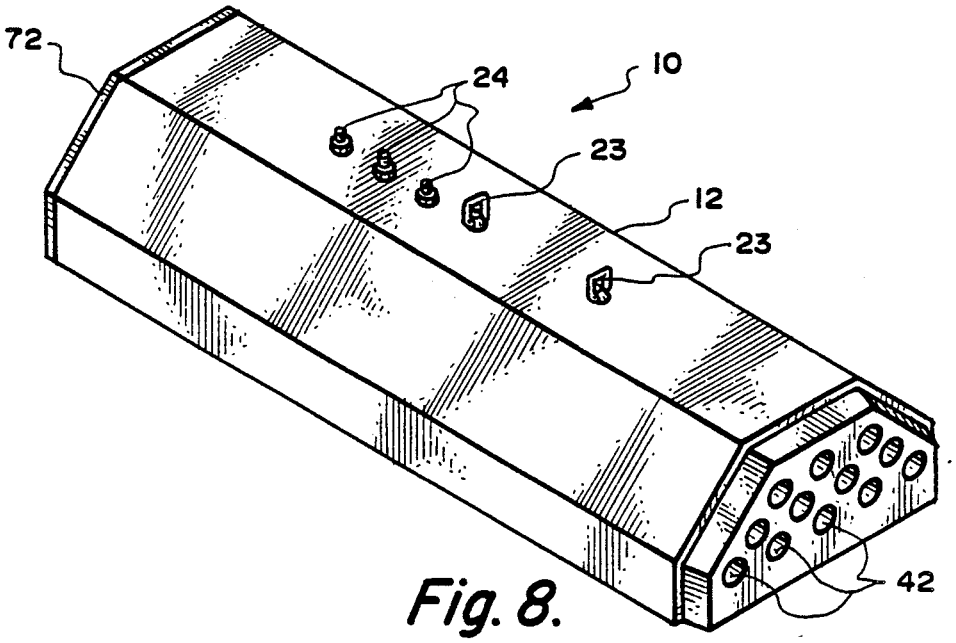
FIG. 8 illustrates an embodiment of the present invention which fires twelve rockets and may be used with helicopters.
Figure 9:
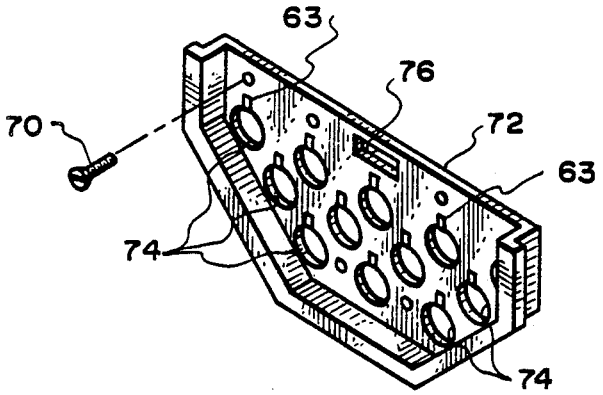
FIG. 9 is an enlarged view of the retention bulkhead used with the rocket launcher of FIG. 8.

Referring to FIGS. 8 and 9 there is shown an embodiment of the present invention which may be used with helicopters or with other aircraft when it is desired to launch only twelve rockets. While this embodiment may include either module 12 or 14 since the modules are identical the following discussion will make reference to module 12 only. A plurality of bolts 70 are used to secure a retention bulkhead 72 to the rear end 37, FIG. 4, of module 12. Retention bulkhead 72, in turn, has twelve openings 74 with each opening aligning with the one of the twelve launch tubes 42 of module 12. Each opening 74 also has a contact finger 63 positioned on its periphery which makes contact with the firing ring 64 of rocket 58, FIG. 7. Retention bulkhead 72 also a rectangular shaped opening 76 which aligns with the rectangular shaped slot 52 module 12. This embodiment of the present invention does not use a front fairing since aerodynamic drag at low subsonic velocities (helicopter velocities) is not critical to the operation of the aircraft.

Referring again to FIG. 2 each mating surface 18 of module 12 or 14 has a rectangular shaped opening 77 through which a male coupling 78 and a female coupling 80 may be extended to allow for the electrical connection of modules 12 and 14.

From the foregoing it may readily be seen that the present invention comprises a new, unique and exceedingly useful rocket launcher which constitutes a considerable improvement over the known prior art. Obviously, many modifications and variations of the present invention are possible in light of the above teachings. It is, therefore, to be understood that within the scope of the appended claims, the invention may be practiced otherwise than as specifically described.

What is claimed is:

1. A lightweight composite rocket launcher for use with helicopters and aircraft, said lightweight composite rocket launcher comprising first and second identically shaped elongated casings, each of said elongated casings having a mating surface and a plurality of elongated launch tubes formed therein, with the axis of each of the launch tubes being substantially parallel to the axis of each of the other launch tubes of said casing, said launch tubes and said casings being fabricated from a lightweight composite material with each elongated casing and the launch tubes formed therein comprising a unitary structure, the mating surfaces of each of said casings having at least four mating members extending therefrom and at least four slots disposed therein, each of the mating members of one of said casings aligning with one of the slots of the other of said casings when the mating surfaces of said first and second casings are juxtaposed, each of said mating members having a minor diameter portion and a major diameter portion and each of said slots having at one end thereof an aperture for receiving the major diameter portion of the aligned mating member, the width of said slot being narrower than the major diameter portion of the aligned mating member such that when the minor diameter portion of said mating member is positioned within said slot the first casing of said rocket launcher is secured to the second casing of said rocket launcher.

2. The lightweight composite rocket launcher of claim 1 wherein the lightweight composite material from which said casings and launch tubes are fabricated is a fiber reinforced synthetic resin.

3. The lightweight composite rocket launcher of claim 1 wherein the lightweight composite material from which said casings and launch tubes are fabricated is a 30% glass fiber reinforced nylon.

4. The lightweight composite rocket launcher of claim 1 wherein the lightweight composite material from which said casings and launch tubes are fabricated is Kevlar.

5. A rocket launch system comprising:

first and second identically shaped elongated casings, each of said elongated casings having a mating surface and a plurality of elongated launch tubes formed therein, with the axis of each of the launch tubes being substantially parallel to the axis of each of the other launch tubes of said casing, said launch tubes and said casings being fabricated from a lightweight composite material with each elongated casing and the launch tubes formed therein comprising a unitary structure;

the mating surface of each of the casings having at least four mating members extending therefrom and at least four slots disposed therein, each of the mating members of one of said casings aligning with one of the slots of the other of said casings when the mating surfaces of said first and second casings are juxtaposed, each of said mating members having a minor diameter portion and a major diameter portion and each of said slots having at one end thereof an aperture for receiving the major diameter portion of the aligned mating member, the width of said slot being narrower than the major diameter portion of the aligned mating member such that when the minor diameter portion of said mating member is positioned within said slot the first casing of said rocket launcher is secured to the second casing of said rocket launcher;

a faring secured to one end of said casings, said faring having a plurality of openings with each of said openings aligning with one of the launch tubes of said casings; and a bulkhead secured to the other end of said casings, said bulkhead having a plurality of openings with each of said openings aligning with one of the launch tubes of said casings.

6. The system of claim 5 wherein the lightweight composite material from which said casings and launch tubes are fabricated is a fiber reinforced synthetic resin.

7. The system of claim 5 wherein the lightweight composite material from which said casings and launch tubes are fabricated is a 30% glass fiber reinforced nylon.

8. The system of claim 5 wherein the lightweight composite material from which said casings and launch tubes are fabricated is Kevlar.

* * * * *